US005781991A

United States Patent [19]

Papon

[11] Patent Number: 5,781,991

[45] Date of Patent: Jul. 21, 1998

[54] METHOD OF CONNECTING MICROCOAXIAL CABLES TO PRINTED CIRCUIT TRACKS

[75] Inventor: Luc Papon, Montmirail, France

[73] Assignee: Axon' Cable S.A., Montmirail, France

[21] Appl. No.: 727,790

[22] Filed: Oct. 7, 1996

[30] Foreign Application Priority Data

Oct. 9, 1995 [FR] France ..... 95 11854

[51] Int. Cl.[6] ..... H01B 13/20

[52] U.S. Cl. ..... 29/828

[58] Field of Search ..... 174/94 R, 117 F, 174/117 FF; 29/828, 840, 843, 850, 872, 868

[56] References Cited

U.S. PATENT DOCUMENTS 5,347,711 9/1994 Wheatcraft et al. ..... 29/843

5,381,795 1/1995 Nordgren et al. ..... 128/633

5,387,764 2/1995 Blom et al. ..... 174/261

*Primary Examiner*—Carl E. Hall

*Assistant Examiner*—Christopher Goins

*Attorney, Agent, or Firm*—Wolf, Greenfield & Sacks, P.C.

[57] ABSTRACT

The invention relates to a method of implementing a shielded multiconductor cable to the tracks of a printed circuit. The conductors have end portions stripped and positioned. A first strip is put into place. Then each conductor core and a portion of its shielding are stripped. The stripped ends are put into position and then fixed to a second strip that is connected to the first strip by arms. The assembly is then fixed to the printed circuit by soldering the stripped ends to the conductor tracks and by soldering the stripped portions of shielding to the shielding connection track.

10 Claims, 3 Drawing Sheets

METHOD OF CONNECTING MICROCOAXIAL CABLES TO PRINTED CIRCUIT TRACKS

FIELD OF THE INVENTION

The present invention relates to a method of connecting a cable made up of a plurality of conductive elements each provided with its own shielding to conductor tracks of a printed circuit.

More precisely, the invention relates to a connection method of the type that enables such connection to be made with printed circuit tracks that are at a very small pitch.

BACKGROUND OF THE INVENTION

Numerous cases exist in which it is necessary to connect a multicoaxial cable having a large number of small-sized coaxial elements electrically to conductor tracks on a printed circuit, the conductor tracks of the circuit being close together.

This problem arises particularly, but not exclusively, when making probes, in particular for echography, probes for non-destructive inspection, or sonars, and more precisely when making the electrical connection that serves to convey signals between a probe and the computer that processes the delivered signals to reconstitute an image. To solve such a problem, it is clear that the reliability and the quality of the connections made is of great importance in conveying signals capable of giving rise to an echographic image that is usable. In particular, this means that the quality of the cabling of the cable to the printed circuits of the computer will have a major impact on the quality of the image transmitted by the probe.

In that application, probe manufacturers are looking for cables of ever-increasing performance, both electrically and dimensionally. 40 gauge or 42 gauge multicoaxial cables have become very common, and even standard, and that does not make cabling the probes any easier. There therefore exists a real need to develop a method that enables such electrical connections to be made between a multicoaxial cable and the circuits of the probe or of any other equivalent apparatus.

The cables used for this type of application are multicoaxial cables of small gauge (AWG36 to AWG44, or even smaller) and of controlled capacitance (commonly 50 pF/m to 100 pF/m). The best known structures for cables of this type have 48 to 304 coaxial elements, or even 512 for two- or three-dimensional probes.

It will be understood that there is thus a need for connecting a very large number of small-sized coaxial conductors and that each connection must also be made with very good electrical quality.

A first solution consists in fixing the coaxial conductors one by one to printed circuits. That solution requires a very great deal of labor and also raises a major problem of reliability since the cabling operations are not automated. Since all of the solder joints are made manually, there is very little chance of all of the coaxial cables having joints of the same quality. Since the method is not reproducible, the risks of error are high.

Another solution consists in using a flexible transition circuit. It consists in soldering the ends of the coaxial conductors to a flexible circuit having windows and connecting the entire flexible circuit to the mother board via a previously provided window. The major advantage of that solution is that the system can be disassembled.

In fact that solution requires conductor elements to be soldered in two successive steps: a first step in which the conductor elements and their shielding are soldered to the flexible transition circuit, followed by the conductor elements and the shielding track being soldered to the printed circuit proper.

Those two successive soldering steps raise serious risks of poor quality in the finally achieved solder joints, thereby degrading the reliability of the electrical connection. In particular, it can be asserted that the method inevitably leads to some solder joints that are cold or dry.

U.S. Pat. No. 5,347,711 describes a connection technique which consists in positioning pre-stripped coaxial conductors on an epoxy plate in which a window and grooves for receiving the conductors have been machined. An adhesive transfer mass is initially deposited on the plate so as to hold the conductors in place. At the bottom of each groove, a metal pellet is deposited and is connected to the conductor via conductive epoxy resin or via a solder joint. The pellets serve as locations for receiving test devices. The advantage of that technique is that it is ready to be applied directly to a printed circuit because of the positioning holes without any need to pass via a flexible transition circuit.

The drawback of such a technique is that the device is itself complex to make which goes against the cost reductions that are being requested, particularly in the medical world. It is necessary to begin by machining the epoxy plates very accurately, then to solder the coaxial cores to the pellets or to stick them with epoxy adhesive, to insert each coax in recesses provided for that purpose in the epoxy plate (which operation is difficult with small-sized conductors), to align the coaxial conductors on an adhesive mass that has previously been placed on the printed circuit, and to reposition an adhesive tape over the coaxial conductors.

OBJECTS AND SUMMARY OF THE INVENTION

An object of the present invention is to provide a method of connecting a multicoaxial cable to the tracks of a printed circuit which is compatible with a small connection pitch while nevertheless ensuring a high level of reliability, enabling manual operations to be restricted or eliminated, thus making automatic connection possible which is conducive to obtaining good reproducibility.

To achieve this end, the method of connecting a cable made up of a plurality of conductor elements to the tracks of a printed circuit, each conductor element comprising a conductor core, a shield separated from the core by a dielectric material, and an outer sheath, comprises the following steps:

- the sheath and the shield are removed from the end of each conductor element over a given length;
- a first tool is used for positioning the ends of said conductor elements relative to one another to match the relative positioning of the conductor tracks;
- a first insulating strip is used to fix the positioned conductor elements together, said strip being fixed at least in part to a portion of the conductor elements that is still provided with sheath;
- the conductor cores at the ends of the conductor elements are stripped;
- a second tool is used to position the stripped ends of the conductor cores relative to one another as a function of the relative positioning of the conductor tracks;
- a second insulating strip is used to fix the prepositioned stripped ends so that a portion of each stripped end is not covered by said second strip, said second strip being positioned relative to said first strip;

a window is provided in such a manner that a portion of the shielding is stripped and not covered by a fixing tape;

the ends of the conductor elements that have been mechanically joined together in this way are positioned facing said conductor tracks; and the stripped ends of the conductor cores where they are not covered by the first strip are soldered to said conductor tracks, and the stripped portions of said shielding are soldered to a shield connection track of said printed circuit.

It will be understood that by using the method of the invention, a cable is obtained in which the ends of the coaxial conductors are accurately positioned relative to one another as a function of the pitch which exists between the tracks of the printed circuit, and that the ends of the coaxial conductors have respective stripped core portions and respective stripped shielding portions. It will also be understood that the above result can be obtained without performing any soldering operation. The assembly is easily positioned relative to the tracks of the printed circuit, and connection is achieved by soldering the conductor cores to the tracks and the shields to the shield connection track. In particular, it can be seen that implementing the method thus gives rise to only one series of soldering operations on the printed circuit.

It will also be understood that the method enables the various coaxial conductors of the cable to be positioned very accurately and to be held accurately in position. Further, it will be understood that because of the presence of the various fixing strips, the relative positioning of the coaxial conductors is independent of the soldering performed on the printed circuit, thereby making the cable easier to disconnect from the printed circuit without loss of relative positioning between the conductors.

BRIEF DESCRIPTION OF THE DRAWINGS

Other characteristics and advantages of the invention appear better on reading the following description of various implementations of the method given as non-limiting examples. The description refers to the accompanying figures, in which.

MORE DETAILED DESCRIPTION

Figure 1A:
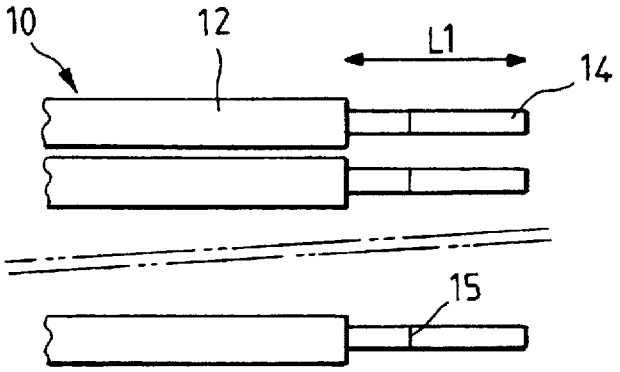
FIGS. 1*a* to 1*e* are plan views showing the various steps in joining together and positioning the ends of the coaxial conductors of the cable in a first implementation of the invention.
Figure 1B:
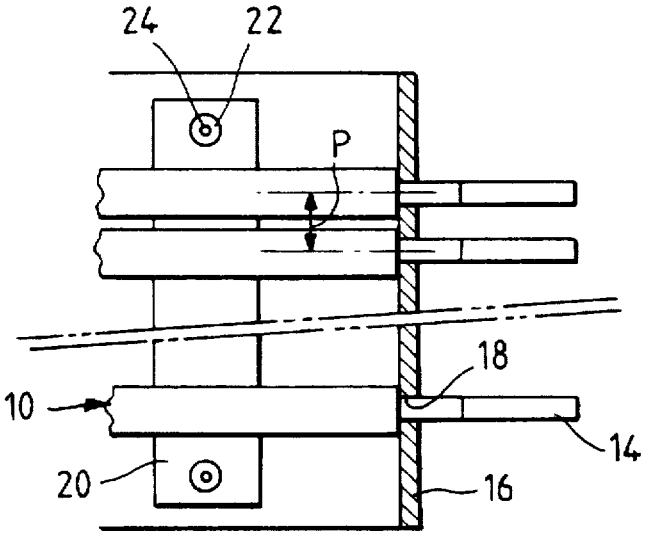
Figure 1C:
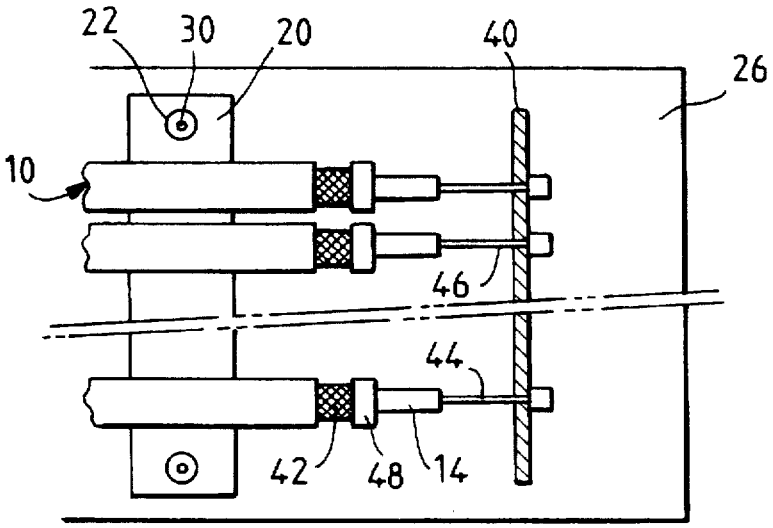
Figure 1D:
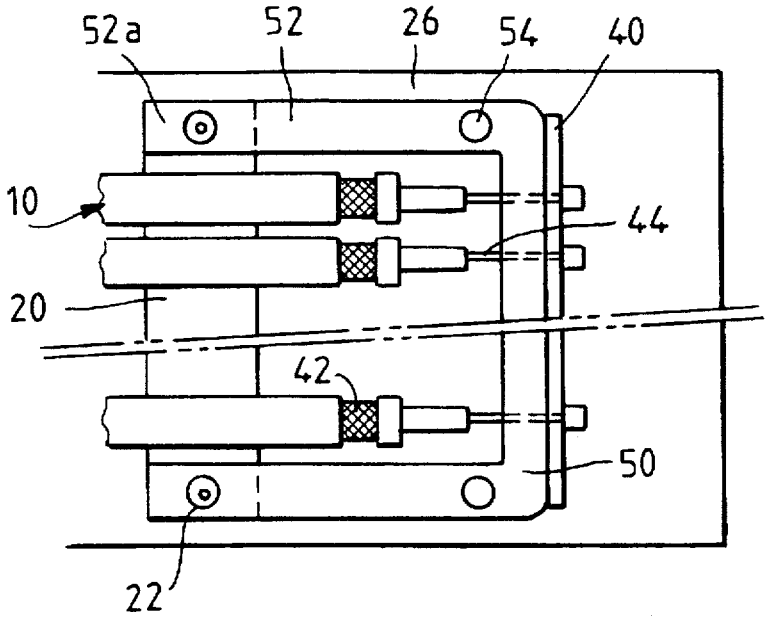
Figure 1E:
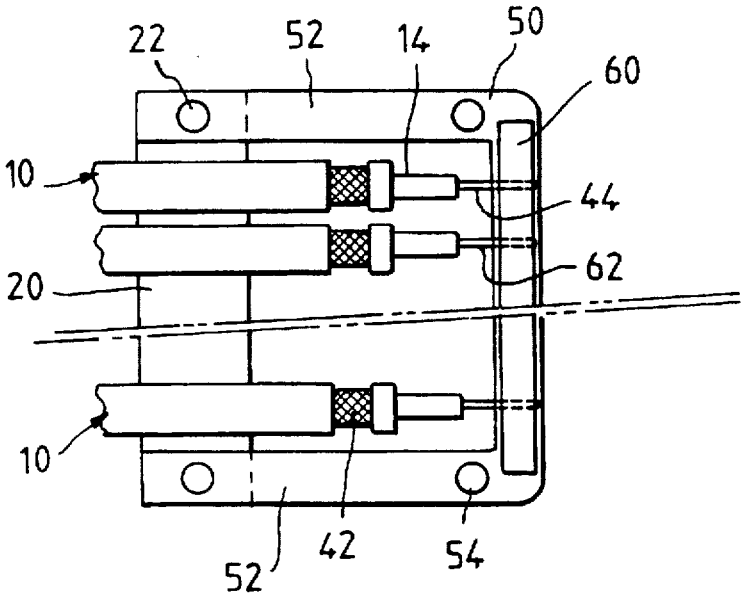
Figure 2:
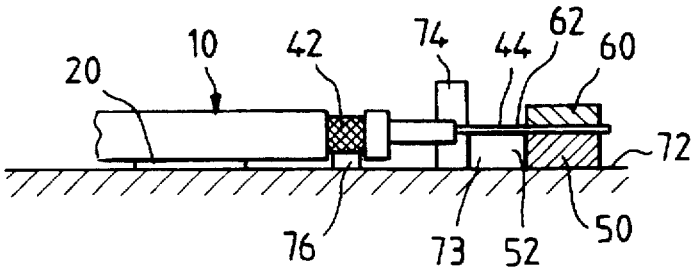
FIG. 2 is an elevation view showing how the previously joined-together ends of the coaxial conductors are fixed to the printed circuit.

With reference initially to FIGS. 1*a* to 1*e*, and also to FIG. 2, there follows a description in detail of a first implementation of the method of connecting the multicoaxial cable to an integrated circuit.

In a first step shown in FIGS. 1*a* to 1*e*, the ends of the coaxial conductors of the cable are appropriate stripped and the ends of the conductors are joined together mechanically so as to hold them at a pitch or spacing that corresponds to that of the conductor tracks of the printed circuit.

Initially, the end of each coaxial conductor is stripped partially. More precisely, in FIG. 1, there can be seen a coaxial element 10 with its outer sheath 12. The end of the element is stripped over a length L1 so as to remove the outer sheath together with the shield. Over the length L1, referenced 14, there remains only the dielectric and the conductor core. Preferably, a starter 15 is also provided for stripping the dielectric.

In the following step, shown in FIG. 1*b*, the various coaxial conductors 10 whose ends 14 have been stripped are positioned flat relative to one another at a determined pitch p by using a positioning tool consisting, for example, in a plate 16 provided with holes 18 at the desired pitch. The ends 14 of the conductors pass through the holes 18 while the remaining portion of the sheath comes into abutment against the plate 16. The coaxial conductors are thus properly positioned flat. A strip or tape 20 of thermoadhesive material is fixed to the coaxial conductors where they still have their sheaths. The thermoadhesive material is preferably a tape of hot melt adhesive having a thickness of 230 microns and having sufficient mechanical strength to maintain the spacing of the coaxial conductors. At each end, this tape is provided with a positioning hole 22 which is engaged on a positioning stud 24 belonging to the first positioning tool 16.

In a following step, shown in FIG. *c*, the stripping of the ends of the coaxial conductors 10 is finished off. To do this, the bundle of coaxial conductors 10 together with its fixing tape 20 is placed on a second tool 26 for stripping, combing, and positioning. The relative positioning of the packet for stripping relative to the tool is provided by cooperation between the positioning hole 22 and a reference stud 30 of the tool. This tool is used to comb and strip the dielectrics by means of a rake, with the stripping performed in this way serving to define a portion 42 in which the shielding is stripped and an end portion 44 on which the conductor core 46 is likewise stripped. Preferably, between each portion 42 and the dielectric 16, a ring 48 of sheath is allowed to remain to prevent the shield from expanding. When the rake 40 of the tool 26 is at the end of its stroke, as shown in FIG. *d*, it positions the ends 44 of the coaxial conductor cores very accurately. Thereafter, the portions 44 are fixed to a second thermoadhesive tape 50 parallel to the tape 20 and of the same kind, which tape is extended by two arms 52. Heat is applied to the tape proper 50 to stick it to the ends 44 of the conductor cores, while the ends 52*a* of the arms 52 are fixed to the first tape 20. Preferably, the arms 52 are provided, close to the strip 50, with positioning holes for positioning the coaxial conductors relative to the printed circuit. In the following step, shown in FIG. 1*e*, the assembly shown in FIG. 1*d* is turned upsidedown so as to fix a third adhesive tape 60 to the stripped cores 44 of the coaxial conductors on their sides remote from the second tape 50. The stripped ends of the cores are thus sandwiched between the strips 50 and 60 while a portion 62 of each stripped core is left free.

After this operation, an assembly is thus obtained constituted by an insulating mechanical frame 70 made up of the insulating strips 20, 50, and 60 with the coaxial conductors securely fixed thereto, said conductors being held parallel to one another at a previously predetermined pitch. The stripped portions of shield 42 and the stripped portions of conductor core 44 are lined up in two columns.

In the following operation, shown in FIG. 2, the assembly 70 is presented to the top of a printed circuit 72 where it is to be connected. The assembly 70 is positioned relative to the printed circuit 72 by positioning studs 74 provided on the printed circuit and on which the positioning holes 54 through the insulating tapes are engaged. Thus, the stripped ends 44 of the cores overlie conductor tracks 73 of the printed circuit and the stripped portions 42 of the shielding overlie the shield connection track 76 of the printed circuit. It then suffices to solder the cores 44 to the tracks 73 and the shields 42 to the track 76.

The conductors 44 are initially soldered with a specially shaped thermode and without adding any solder other than the solder already deposited on the conductors. The soldering temperature preferably lies in the range 163° C. to 180° C.

Thereafter the shields 42 are soldered with a thermode using a solder preform and the soldering temperature lies in the range 120° C. to 139° C.

A temperature gap delta T of at least 20° C. is maintained between the two temperature ranges.

Care is taken to use probe end or DL5 connector end printed circuit tracks having a coating of solderable NiAu or preferably a selective solderable coating so as to avoid any mixing of solder and so as to avoid changing the temperature ranges. The tracks of the printed circuit may be provided with the same kind of solder as that which is used thereafter for performing soldering. In addition, the higher solder melting temperature (163° C.) does not under any circumstances affect the hot-melt tape during the soldering cycle. It should be emphasized that these two soldering operations are performed automatically, thereby imparting very good reproducibility thereto.

Figure 3:
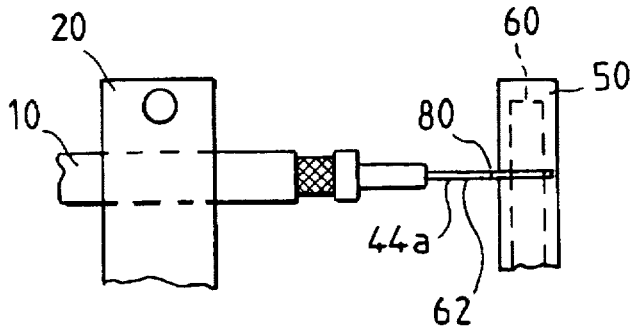
FIG. 3 is a plan view showing a second implementation of the invention.

With reference to FIG. 3, a second implementation of the invention is described. The second implementation differs from the previous implementation essentially by the fact that the second insulating strip 50 does not have arms for fixing to the first strip 20 and by the fact that no third strip is provided.

In addition, while the conductor cores are being stripped, a nick 80 is made in each of them in the portion 44*a* that is not covered by the strip 50.

After this assembly has been soldered to the printed circuit in the manner already explained with reference to FIG. 2, the ends of the conductor cores secured to the strip 50 can be broken off, the conductor cores then being soldered to the conductor tracks via their portions 44*a*.

Figure 3A:
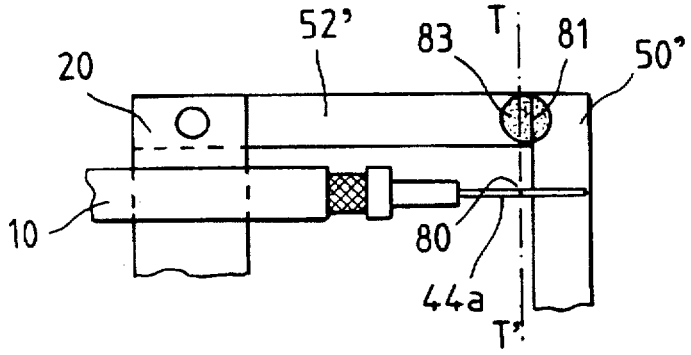
FIG. 3*a* is a plan view showing a variant of the implementation of FIG. 3.

FIG. 3*a* shows a variant of FIG. 3 that also makes it possible to remove the strip 50' after fixing to the printed circuit together with the ends of the conductor cores fixed thereto. For this purpose, the arms 52' are separated from the strip 50' by respective through cuts 81. A temporary mechanical connection is obtained between the strip 50' and the branches 52' by means of a drop of wax 83 or any other material that melts at the soldering temperature. In addition, the ends 44*a* of the conductor cores are provided with nicks 80.

After the conductor elements and the shields have been soldered to the printed circuit, in the manner explained above, it is easy to separate the strip 50' by breaking along the line TT'.

Figure 4A:
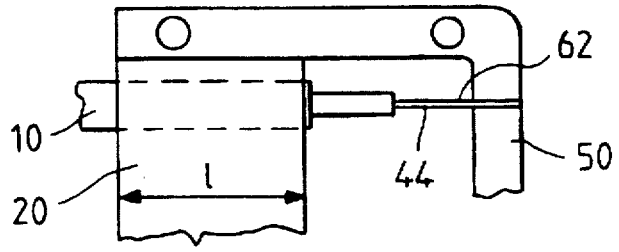
FIGS. 4*a* and 4*b* are plan views showing a third implementation of the invention.
Figure 4B:
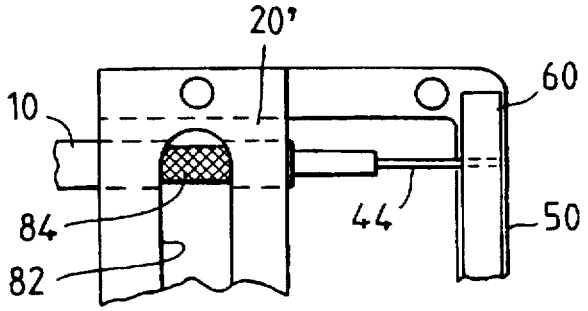

With reference to FIGS. 4*a* and 4*b*, a third implementation of the invention is described.

In this implementation, the first thermoadhesive strip 20' is of greater width 1 in the axial direction of the conductors 10.

During the second stripping step, only the ends of the conductor cores 44 are stripped and no portion of shield is stripped. The second strip 50 is then put into place together with the third strip 60 which are identical to those of FIG. 1*e*.

In a special step, preferably by means of a laser beam, a window 82 is opened through the first strip 20'. This window extends over the major portion of the length of the strip 20' so as to include all of the coaxial conductors 10. This same laser step serves to remove the sheath locally from each coaxial conductor so as to strip a portion 84 of its shield in the window 82. These stripped shield portions 84 are then soldered to the shield connection track of the printed circuit.

It should also be added that the positioning studs 74 on the printed circuit can also be used to secure a mechanical part such as a clip or an insulating bar with corresponding holes serving to reinforce the mechanical connection between the printed circuit and the ends of the cable conductors.

I claim:

1. A method of connecting a cable made of a plurality of conductor elements to the conductor tracks of a printed circuit, each conductor element comprising a conductor core, a shield separated from the core by a dielectric material, and an outer sheath, the method comprising the following steps:

removing the sheath and the shield from the end of each conductor element over a given length;

positioning the ends of said conductor elements relative to one another to match the relative positioning of the conductor tracks using a first tool;

fixing the positioned conductor elements together using a first insulating strip, said strip being fixed at least in part to a portion of the conductor elements that is still provided with the sheath;

stripping the conductor cores at the ends of the conductor elements;

positioning the stripped ends of the conductor cores relative to one another as a function of the relative positioning of the conductor tracks using a second tool;

fixing the prepositioned stripped ends using a second insulating strip so that a portion of each stripped end is not covered by said second strip, said second strip being positioned relative to said first strip;

providing a window in such a manner that a portion of the shielding is stripped and not covered by a fixing tape;

positioning the ends of the conductor elements that have been mechanically joined together to face said conductor tracks; and soldering the stripped ends of the conductor cores where they are not covered by the first strip to said conductor tracks, and soldering the stripped portions of said shielding to a shield connection track of said printed circuit.

2. A method according to claim 1, further comprising the step of providing said first strip with position-marking holes.

3. A method according to claim 2, further comprising the step of providing said second strip with position-marking holes for positioning it relative to the first strip.

4. A method according to claim 3, further comprising the step of providing one of said strips with means for marking its position relative to the printed circuit.

5. A method according to claim 1, further comprising the step of providing said second strip with extensions for mechanically joining together said first and second strips.

6. A method according to claim 1, further comprising the step of providing said second strip with two connection arms, a first end of each arm being fixable to a respective end of said first strip, the other end of each arm being connected to a respective end of said second strip via temporary connection means.

7. A method according to claim 6, further comprising the step of providing each conductor stripped end with a nick preformed in its portion that is not covered by the second strip.

8. A method according to claim 1, further comprising the step of fixing said first strip in such a manner as to leave a portion of the stripped shielding free.

9. A method according to claim 1, further comprising the steps of fixing said fist strip in such a manner as to cover the stripped shielding portions completely, and making a window through said first strip to uncover a stripped portion of shielding for each conductor element.

10. A method according to claim 1, further comprising the step of fixing a third strip of insulating material to the stripped ends of the conductors so as to overlie said second strip.

* * * * *